US010273887B2

(12) United States Patent
Okada et al.

(10) Patent No.: US 10,273,887 B2
(45) Date of Patent: Apr. 30, 2019

(54) ENGINE

(71) Applicant: Yanmar Co., Ltd., Osaka-shi, Osaka-fu (JP)

(72) Inventors: Hideshi Okada, Osaka (JP); Hirotoshi Kihara, Osaka (JP)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 15/558,994

(22) PCT Filed: Mar. 11, 2016

(86) PCT No.: PCT/JP2016/057843
§ 371 (c)(1),
(2) Date: Sep. 15, 2017

(87) PCT Pub. No.: WO2016/148082
PCT Pub. Date: Sep. 22, 2016

(65) Prior Publication Data

US 2018/0245526 A1 Aug. 30, 2018

(30) Foreign Application Priority Data

Mar. 17, 2015 (JP) ..... 2015-053180

(51) Int. Cl.
*F02D 35/02* (2006.01)
*F02D 45/00* (2006.01)
(Continued)

(52) U.S. Cl.
CPC ..... *F02D 35/02* (2013.01); *F01P 3/00* (2013.01); *F02D 41/042* (2013.01);
(Continued)

(58) Field of Classification Search
CPC ... F02D 35/02; F02P 9/00; F02P 9/002; F01P 3/00; F25B 13/00; F25B 49/02
USPC ..... 701/102, 110–115; 123/350
See application file for complete search history.

(56) References Cited

U.S. PATENT DOCUMENTS

2004/0184507 A1* 9/2004 Tsukamoto ..... F01P 11/16 374/57
2008/0110158 A1* 5/2008 Esaka ..... F02D 41/22 60/286
(Continued)

FOREIGN PATENT DOCUMENTS

DE 102010017037 A1 1/2011
EP 2447518 A1 5/2012
(Continued)

OTHER PUBLICATIONS

International Search Report dated Apr. 5, 2018 issued in corresponding PCT Application PCT/US2016/057843.
(Continued)

*Primary Examiner* — John Kwon
*Assistant Examiner* — Johnny H Hoang
(74) *Attorney, Agent, or Firm* — Norton Rose Fulbright US LLP

(57) ABSTRACT

In a case where a control device receives a stop signal instructing stopping of an engine and the control device determines that the engine temperature is lower than a predetermined temperature based on a signal from a timer or based on a signal from a cooling water temperature sensor, an operation control is maintained until the control device determines that the engine temperature is the predetermined temperature or higher. This way, an engine is provided which is capable of restraining generation of blowby condensate water without stopping a cooling water pump during the operation of the engine.

14 Claims, 3 Drawing Sheets

(51) Int. Cl.

| | |
|---|---|
| ***F01P 3/00*** | (2006.01) |
| ***F02P 9/00*** | (2006.01) |
| ***F25B 13/00*** | (2006.01) |
| ***F25B 49/02*** | (2006.01) |
| ***F02D 41/04*** | (2006.01) |
| ***F02D 41/06*** | (2006.01) |
| *F25B 31/02* | (2006.01) |
| *F25B 41/04* | (2006.01) |
| *F02D 29/04* | (2006.01) |

(52) U.S. Cl.
CPC ..... *F02D 41/064* (2013.01); *F02D 45/00* (2013.01); *F02P 9/002* (2013.01); *F25B 13/00* (2013.01); *F25B 49/02* (2013.01); *F01P 2025/08* (2013.01); *F02D 29/04* (2013.01); *F02D 41/061* (2013.01); *F02D 2200/021* (2013.01); *F02D 2250/08* (2013.01); *F02D 2250/14* (2013.01); *F25B 31/02* (2013.01); *F25B 41/046* (2013.01); *F25B 2313/005* (2013.01); *F25B 2313/02741* (2013.01); *F25B 2327/001* (2013.01); *F25B 2400/075* (2013.01); *F25B 2500/27* (2013.01)

(56) References Cited

U.S. PATENT DOCUMENTS

2008/0162017 A1* 7/2008 Nagata ..... F02D 35/02 701/103
2010/0242930 A1* 9/2010 Shinohara ..... F02D 13/0265 123/568.14
2013/0006499 A1* 1/2013 Date ..... F02D 41/042 701/104
2013/0319026 A1* 12/2013 Tsuji ..... F25B 49/02 62/216
2015/0184610 A1* 7/2015 Onozawa ..... F02D 41/222 123/294
2016/0010613 A1* 1/2016 O'Brien ..... F01P 3/00 123/179.3

FOREIGN PATENT DOCUMENTS

| | | | |
|---|---|---|---|
| EP | 2449236 | A1 | 5/2012 |
| EP | 2615213 | A2 | 7/2013 |
| JP | 2825207 | A | 9/1998 |
| JP | 2004-007948 | A | 1/2004 |
| JP | 2006-046285 | A | 2/2006 |
| JP | 2008080914 | A | 4/2008 |
| JP | 2013-050088 | A | 3/2013 |
| WO | 2014/122823 | A1 | 8/2014 |

OTHER PUBLICATIONS

European Search Report dated Jan. 3, 2019 issued in corresponding European Application No. 16764912.8 cites the patent documents above.

* cited by examiner

ENGINE

CROSS REFERENCES TO RELATED APPLICATIONS

This application is a national stage application pursuant to 35 U.S.C. § 371 of International Application No. PCT/JP2016/057843, filed on Mar. 11, 2016, which claims priority under 35 U.S.C. § 119 to Japanese Patent Application No. 2015-053180, filed on Mar. 17, 2015, the disclosures of which are hereby incorporated by reference in their entireties.

TECHNICAL FIELD

The present invention relates to an engine.

BACKGROUND ART

There has been traditionally known a phenomenon in which, when starting and stopping of an engine are repeated, vapor of the blowby gas leaking out from a combustion chamber liquefies due to insufficient warming up of the engine. Further, it is also known that the engine oil is deteriorated, if the blowby condensate water generated by this liquefaction mixes into an engine oil (e.g., see Patent Literature 1, hereinafter PTL 1).

To address this issue, the engine of PTL 1 stops the cooling water pump in the early stage of the operation, to avoid cooling of the engine. This induces an increase in the temperature of the engine, which restrains cooling of the blowby gas and restrains generation of the blowby condensate water.

CITATION LIST

Patent Literature

PTL1: Japanese Patent No. 2825207

SUMMARY OF INVENTION

Technical Problem

However, in the above traditional engine, stopping the cooling water pump at the early stage of the operation may cause a hot spot locally around the combustion chamber of the engine, which may lead to heat deterioration.

In view of the above, an object of the present invention is to provide an engine that can restrain generation of blowby condensate water without stopping a cooling water pump during operation of the engine.

Solution to Problem

To solve the above problem, an engine of a first mode of the present invention may include:

an engine temperature specifying unit configured to specify an engine temperature; and a control device configured to execute engine control based on the engine temperature specified by the engine temperature specifying unit, wherein an operation of the engine is continued, in a case where the control device receives a stop signal indicative of stop of the engine and the control device determines the engine temperature is lower than a predetermined temperature.

Advantageous Effects of Invention

With the present invention, generation of blowby condensate water can be restrained without stopping a cooling water pump during the operation of an engine.

DESCRIPTION OF EMBODIMENTS

An engine of a first mode of the present invention includes: an engine temperature specifying unit configured to specify an engine temperature; and a control device configured to execute engine control based on the engine temperature specified by the engine temperature specifying unit, wherein an operation of the engine is continued, in a case where the control device receives a stop signal indicative of stop of the engine and the control device determines the engine temperature is lower than a predetermined temperature.

In such a structure, operation of the engine is continued, in a case where the control device receives a stop signal instructing stopping of the engine and the control device determines the engine temperature is less than a predetermined temperature. Therefore, when the control device receives the stop signal instructing stopping of the engine, the drop in the temperature of the blowby gas can be restrained by heat from the engine, and liquefaction of the vapor in the blowby gas can be restrained.

Further, with this structure, the cooling water pump can be driven always while the engine is operated. Therefore, a local hot spot due to stopping of the cooling water pump does not occur in the engine.

Further, an engine of a second mode of the present invention may be such that, in the first mode, the engine temperature specifying unit includes a cooling water temperature sensor configured to detect a temperature of the engine cooling water.

With such a structure, the engine temperature can be easily and accurately detected.

In the following, the present invention is described in detail with reference to the illustrated embodiments.

Figure 1:
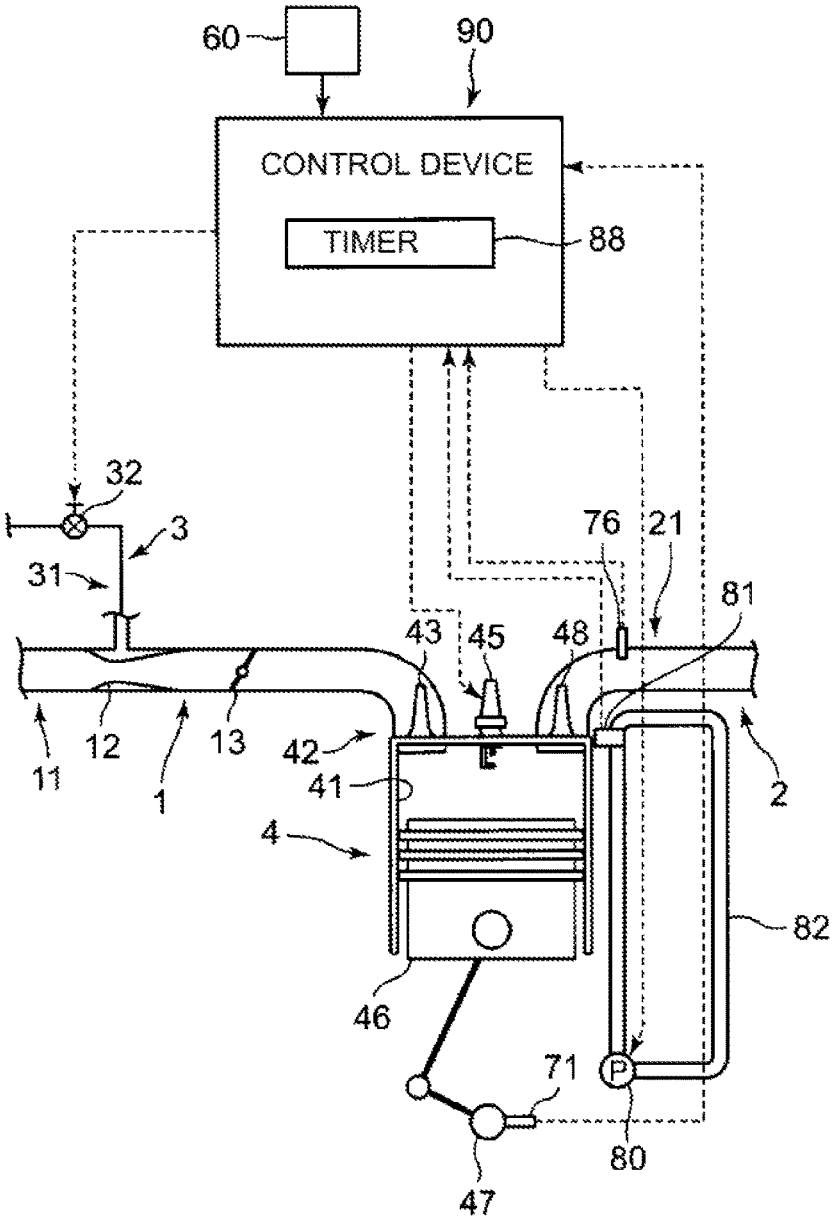
FIG. 1 is a schematic structure diagram showing a part of an engine of one embodiment of the present invention.

FIG. 1 is a schematic structure diagram showing a part of an engine of one embodiment of the present invention.

This engine is a gas engine that uses a gaseous fuel gas such as natural gas and the like. This engine is mounted in an engine-driven heat pump. This engine includes an air-supply channel 1, an exhaustion channel 2, a fuel-gas-supply channel 3, and an engine main body 4.

The air-supply channel 1 includes an air-supply tube 11, a venturi 12, and a throttle valve 13. The air-supply tube 11 supplies a fuel-air mixture generated by mixing the fuel gas with the air taken in from outside. The venturi 12 causes a differential pressure between the fuel gas and the air inside the fuel-gas-supply channel. The throttle valve 13 adjusts the amount of the fuel-air mixture supplied.

The exhaustion channel 2 includes an exhaustion tube 21. The exhaustion tube 21 is configured to guide exhaust gas generated by combusting the fuel-air mixture in a later-described combustion chamber 41 to outside the engine. The fuel-gas-supply channel 3 includes a fuel-gas-supply tube 31 and a fuel-gas-supply amount adjusting valve 32. The fuel-gas-supply tube 31 is configured to guide the fuel gas to the air-supply channel 1. Further, the fuel-gas-supply amount adjusting valve 32 plays a role of adjusting the amount of fuel gas contained in the fuel-air mixture.

The engine main body 4 includes a combustion chamber 41, a cylinder head 42, an air-supply valve 43, a spark plug 45, a piston 46, a crank shaft 47, and an exhaustion valve 48. The combustion chamber 41 is a chamber for combusting the fuel-air mixture. Further, the air-supply valve 43 performs open/close operation in the cylinder head 42 to communicate or block the air-supply tube 11 and the combustion chamber 41 with/from each other. The spark plug 45 generates a spark for combusting fuel-air mixture supplied to the combustion chamber 41. The piston 46 reciprocates in up-and-down directions, with the combustion and expansion of the fuel-air mixture supplied in the combustion chamber 41, and the crank shaft 47 makes rotary motion by the reciprocating motion of the piston 46. Further, the exhaustion valve 48 performs open/close operation in the cylinder head 42 to communicate or block the exhaustion tube 21 and the combustion chamber 41 with/from each other.

The engine further includes an engine speed sensor 71, an exhaust gas temperature sensor 76, and a control device 90. The engine speed sensor 71 detects an engine speed by detecting the number of teeth of a gear provided to the crank shaft 47. On the other hand, the exhaust gas temperature sensor 76 is provided in the exhaustion tube 21 and detects the temperature of the exhaust gas.

To the control device 90, signals from the above described various sensors 71 and 76 and signals from an operation unit 60 structured by, for example, a remote controller and the like are input. Although details are omitted, the control device 90 is configured to suitably control the opening and the like of the throttle valve 13 based on signals from the above various sensors 71 and 76, or signals from the operation unit 60, thereby performing control of the engine speed and the like. It should be noted that the control device 90 performs not only the control of the engine, but also control of a later-described heat pump. The control device 90 may be structured by a plurality of members arranged apart from each other.

As shown in FIG. 1, the engine further includes a cooling water pump 80 and a cooling water temperature sensor 81. The cooling water pump 80 operates under control of the control device 90, during operation of the engine, and circulates cooling water in a cooling water channel 82 to restrain heat deterioration of each unit of the engine. Further, the cooling water temperature sensor 81 detects the temperature of the engine by measuring the temperature of the cooling water in a water jacket (not-shown) provided in the cylinder head 42.

Further, a not-shown winding-belt is wound about flywheel which rotates in sync with a crank shaft 47 of the gas engine (see FIG. 1), a first electromagnetic clutch, and a second electromagnetic clutch. Rotary power of the gas engine is transmitted to the first electromagnetic clutch and the second electromagnetic clutch through the flywheel and the winding-belt, and from the first electromagnetic clutch to later-described compressors of the heat pump.

Figure 2:
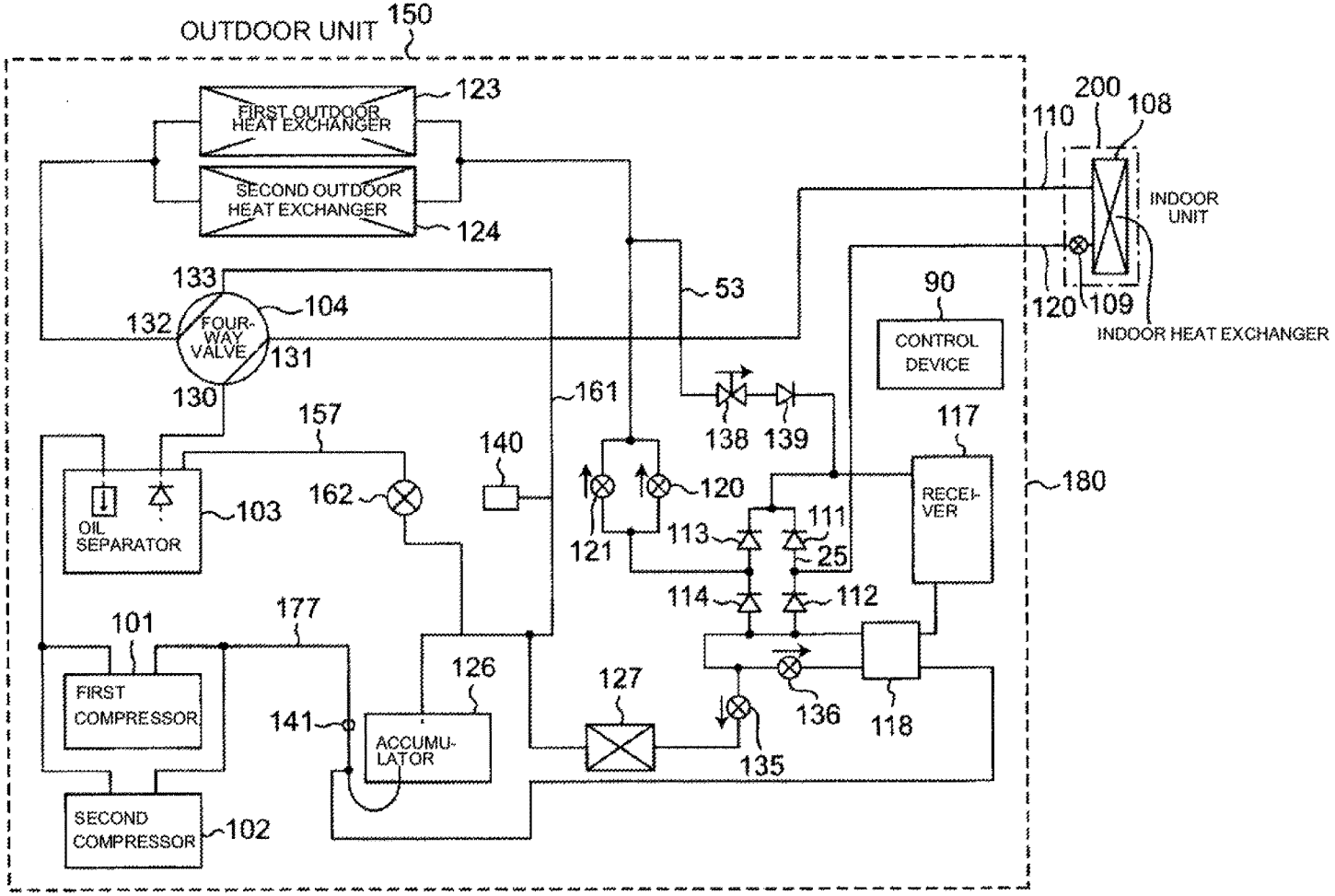
FIG. 2 is a diagram showing a simplified refrigerant circuit of a heat pump driven by the engine shown in FIG. 1.

FIG. 2 is a diagram showing a simplified refrigerant circuit of the heat pump driven by the engine.

As shown in FIG. 2, the heat pump includes an outdoor unit 150, an indoor unit 200, a gas refrigerant pipe 110 and a liquid refrigerant pipe 120. It should be noted that the dotted line given a reference number of 180 in FIG. 2 indicates a package of the outdoor unit 150. As shown in FIG. 2, the gas refrigerant pipe 110 and the liquid refrigerant pipe 120 each connect the outdoor unit 150 with the indoor unit 200.

The outdoor unit 150 includes: a first compressor 101, a second compressor 102, an oil separator 103, a four-way valve 104, a first check valve 111, a second check valve 112, a third check valve 113, a fourth check valve 114, a receiver 117, and a supercooling heat exchanger 118. Further, the outdoor unit 150 includes: a first electronic expansion valve 120, a second electronic expansion valve 121, a first outdoor heat exchanger 123, a second outdoor heat exchanger 124, an accumulator 126, a refrigerant auxiliary evaporator 127, a third electronic expansion valve 135, a fourth electronic expansion valve 136, an electromagnetic valve 138, and a fifth check valve 139. On the other hand, the indoor unit 200 includes an indoor heat exchanger 108 and a fifth electronic expansion valve 109. It should be noted that there are cases in which a plurality of indoor units 200 are connected to the outdoor unit 150.

The control device 90 (see FIG. 1 and FIG. 2) outputs control signals to the first compressor 101, the second compressor 102, the four-way valve 104, the first electronic expansion valve 120, the second electronic expansion valve 121, the third electronic expansion valve 135, the fourth electronic expansion valve 136, the fifth electronic expansion valve 109, and the electromagnetic valve 138, and controls these units. The control device 90 is electrically connected to these units through not-shown signal lines.

This heat pump performs cooling and heating operations as follows. First, in a heating operation, the control device 90 controls the four-way valve 104 to connect a first port 130 to a second port 131 of the four-way valve 104, and connects a third port 132 to a fourth port 133 of the four-way valve 104.

In the heating operation, a high-pressure gas refrigerant ejected from the compressors 101 and 102 first flow into the oil separator 103. The oil separator 103 separates lubricant oil of the compressors 101 and 102 from the gas refrigerant. The lubricant oil separated from the gas refrigerant in the oil separator 103 returns to the compressors 101 and 102 through a not-shown line.

The gas refrigerant sequentially passes the oil separator 103 and the four-way valve 104 and flows into the indoor heat exchanger 108. The gas refrigerant gives heat to the indoor heat exchanger 108 and is liquefied into a liquid refrigerant. In the heating operation, the fifth electronic expansion valve 109 is controlled to be full-open by the control device 90. The liquid refrigerant having been liquefied after giving heat to the indoor heat exchanger 108 flows into the receiver 117 via the first check valve 111.

The receiver 117 plays a role of storing the liquid refrigerant. Then, the liquid refrigerant exits from a bottom portion of the receiver 117, passes the supercooling heat exchanger 118, passes the fourth check valve 114, and flows towards the first and the second electronic expansion valves 120 and 121.

It should be noted that, due to pressure loss in the channel, the pressure of the liquid refrigerant having exited from the bottom portion of the receiver 117 is lower than the pressure of the liquid refrigerant on a flow-out side of the second check valve 112 or the pressure of the liquid refrigerant on flow-out sides of the first and the third check valves 111 and 113. This way, the liquid refrigerant having exited from the bottom portion of the receiver 117 does not flow to the second check valve 112 or the third check valve 113, but flows from the fourth check valve 114 towards the first and the second electronic expansion valves 120 and 121.

Then, the liquid refrigerant is expanded, atomized into mist in the first and the second electronic expansion valve 120 and 121. The openings of the first and the second electronic expansion valves 120 and 121 are freely controllable by the control device 90, and the openings of the first and second electronic expansion valves 120 and 121 are controlled by the control device 90 so that the degree of superheat of the gas refrigerant in the line 177 is a predetermined degree or higher. It should be noted that, while the pressure of the refrigerant before passing the first and the second electronic expansion valves 120 and 121 is high, the pressure of the same becomes low after passing the first and the second electronic expansion valves 120 and 121.

Then, the liquid refrigerant in the form of moist mist is subjected to heat exchanging with the external air and receives heat from the external air to be gasified, in the first and the second outdoor heat exchanger 123 and 124. As described, while the refrigerant gives heat to the indoor heat exchanger 108, it receives heat from the outdoor heat exchangers 123 and 124. Then, the gasified refrigerant passes the four-way valve 104 and reaches the accumulator 126. The accumulator 126 separates the gas refrigerant and mist refrigerant from each other. If the refrigerant in the form of the mist returns to the compressors 101 and 102, the slide portions of the compressors 101 and 102 may be damaged. The accumulator 126 serves as a buffer container which temporarily store the liquid refrigerant, for the purpose of preventing such a situation. Then, the gas refrigerant having passed the accumulator 126 flows into inlet ports of the compressors 101 and 102.

In cases where the third electronic expansion valve 135 is opened under control by the control device 90, the liquid refrigerant having passed the supercooling heat exchanger 118 partially flows into the refrigerant auxiliary evaporator 127, after being turned into mist in the third electronic expansion valve 135. To the refrigerant auxiliary evaporator 127, a gas engine cooling water (cooling water of 60° C. to 90° C.) is introduced.

The liquid refrigerant in the form of mist having flown into the refrigerant auxiliary evaporator 127 is subjected to heat exchanging with the engine cooling water to turn into gas, and then reaches the accumulator 126. This way, the heat exchanging performance is made high in contrast with the first and the second outdoor heat exchangers 123 and 124. It should be noted that, in the heating operation, the fourth electronic expansion valve 136 is usually controlled to be completely closed.

Next, the cooling operation is described. In the cooling operation, the control device 90 controls the four-way valve 104 to connect the first port 130 to the third port 132 of the four-way valve 104, and connect the second port 131 to the fourth port 133 of the four-way valve 104. For a case of cooling, the flow of heat is simply described hereinbelow.

In cases of cooling operation, gas refrigerant ejected from the first and the second compressors 101 and 102 passes the oil separator 103, and then passes the four-way valve 104, and reaches the first and second outdoor heat exchanger 123 and 124. At this time, the temperature of the refrigerant is high, and therefore the refrigerant is cooled in the first and the second outdoor heat exchanger 123 and 124, even with the air of intense heat of the summer (30 to 40° C.). The heat is taken from the gas refrigerant in the first and the second outdoor heat exchanger 123 and 124, thus turning into liquid refrigerant.

In the cooling operation, the control device 90 controls the opening of the first and the second electronic expansion valves 120 and 121 to a suitable opening, and controls the electromagnetic valve 138 to be full-open. The liquid refrigerant having passed the first and the second outdoor heat exchangers 123 and 124 mainly passes the electromagnetic valve 138 and the check valve 139, and reaches the receiver 117. Then, the liquid refrigerant exits from the bottom portion of the receiver 117, passes the supercooling heat exchanger 118, and flows from a portion between the second check valve 112 and the first check valve 111 towards the fifth electronic expansion valve 109.

The opening of the fifth electronic expansion valve 109 is freely controllable by the control device 90, and the opening of the fifth electronic expansion valve 109 is controlled by the control device 90 so that the degree of superheat of the gas refrigerant in the line 177 is a predetermined degree or higher. The liquid refrigerant having reached the fifth electronic expansion valve 109 is expanded and atomized into mist at the fifth electronic expansion valve 109, and then flows into the indoor heat exchanger 108. The mist of the low temperature liquid refrigerant having flown into the indoor heat exchanger 108 takes away the heat from the indoor heat exchanger 108 to cool down the indoor air, and on the other hand, the refrigerant is gasified by the heat given from the indoor heat exchanger 108. As described, while the refrigerant takes away heat from the indoor heat exchanger 108, it radiates the heat to the first and the second outdoor heat exchanger 123 and 124. Then, the gasified gas refrigerant sequentially passes the four-way valve 104 and the accumulator 126, and flows into the inlet port of the compressors 101 and 102.

Further, when the control device 90 receives a signal from the operation unit 60 (see FIG. 1) in a hot occasion and the like during a summer, the control device 90 controls the opening of the fourth electronic expansion valve 136 to a suitable opening. Then, liquid refrigerant having passed the receiver 117 and the supercooling heat exchanger 118 is partially cooled by passing the fourth electronic expansion valve 136, and flows into the supercooling heat exchanger 118. This way, heat exchanging is performed between the liquid refrigerant from the receiver 117 flown into the supercooling heat exchanger 118 without going through the fourth electronic expansion valve 136 and the liquid refrigerant flown into the supercooling heat exchanger 118 through the fourth electronic expansion valve 136. Then, while the liquid refrigerant to be fed to the indoor heat exchanger 108 is further cooled, the liquid refrigerant having passed the fourth electronic expansion valve 136 is gasified by warming, and fed towards the compressors 101 and 102.

As shown in FIG. 2, the heat pump further includes a bypass channel 157 and a sixth electronic expansion valve 162. The bypass channel 157 short-circuits the oil separator 103 and the accumulator 126. The sixth electronic expansion valve 162 is provided in the bypass channel 157. The opening of the sixth electronic expansion valve 162 is freely controllable by the control device 90. The sixth electronic expansion valve 162 plays a role of adjusting the flow rate of the gas refrigerant passing through the bypass channel 157.

Further, as shown in FIG. 2, this heat pump further includes a pressure sensor 140 and a temperature sensor 141. The pressure sensor 140 is provided in a line 161 through which gas refrigerant from the four-way valve 104 returns to the accumulator 126, and detects the pressure of the gas refrigerant passing the line 161. Further, the temperature sensor 141 is provided in a line 177 through which gas refrigerant from the accumulator 126 returns to the compressors 101 and 102, and detects the temperature of the gas refrigerant passing the line 177. The pressure sensor 140 and the temperature sensor 141 are each configured to output signals to the control device 90. The control device 90 calculates the saturated steam temperature of the gas refrigerant passing the line 161 based on a signal from the pressure sensor 140. Then, based on this saturated steam temperature and the temperature of the gas refrigerant passing the line 177, which temperature is detected based on the signal from the temperature sensor 141, the degree of superheat is calculated. Then, to make this degree of superheat equal to a predetermined value or higher, the openings of the first and the second electronic expansion valves 120 and 121 are controlled during the heating operation, whereas in the cooling operation, the opening of the fifth electronic expansion valve 109 is controlled.

Figure 3:
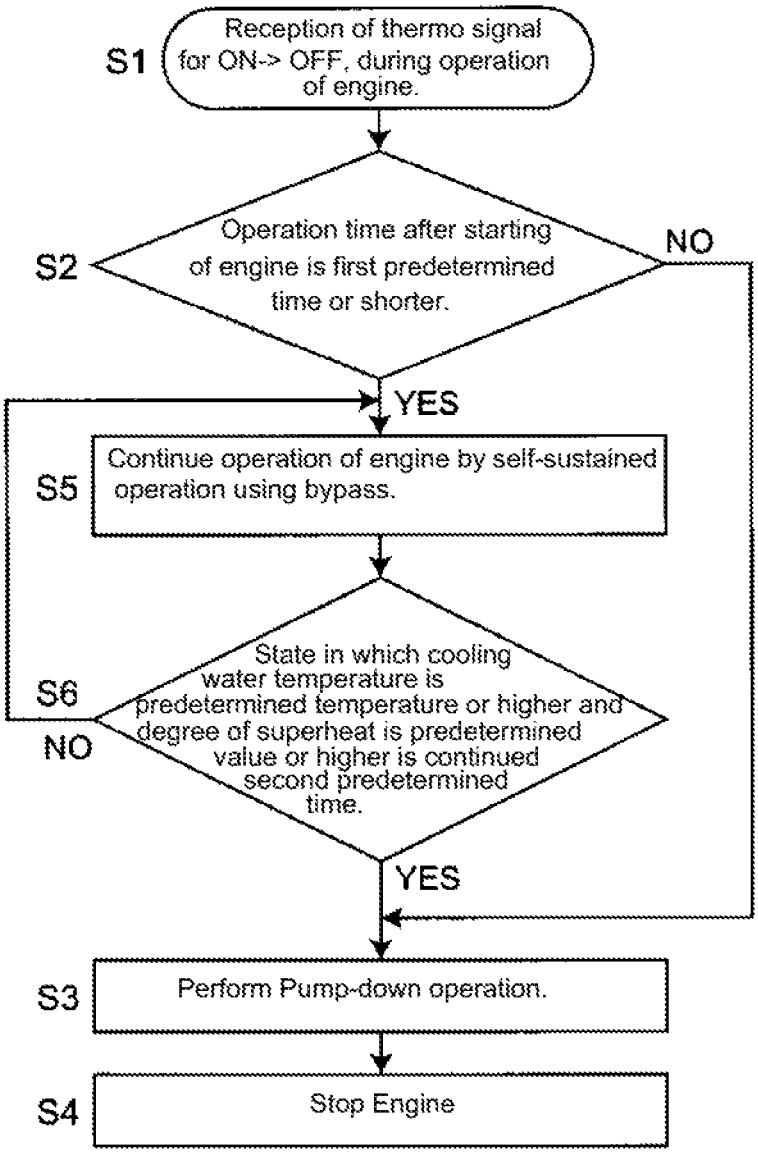
FIG. 3 is a flowchart showing steps of control by a control device 90 from the point of the control device receiving a stop signal until the point where the engine stops.

FIG. 3 is a flowchart showing steps of control by a control device 90 from the point of the control device 90 receiving a stop signal until the point where the engine stops.

Referring to FIG. 3, when the control device 90 receives, in step S1, a thermo signal as an example stop signal from a temperature sensor (not shown) installed in the indoor unit 200, the process proceeds to step S2. It should be noted that the thermo signal herein is a signal indicating that the room temperature has reached a set temperature, and is sent for the purpose of stopping the compressors 101 and 102.

In step S2, the control device 90 determines whether the operating time after starting of the engine is a first predetermined time or shorter, based on information from a timer 88 (see FIG. 1). Here, in cases where the operating time after the starting of the engine is determined as to be longer than the first predetermined time, the process proceeds to step S3, assuming that the engine temperature is a predetermined temperature or higher.

It should be noted that the first predetermined time may be 10 minutes, for example; however, the first predetermined time may be varied to any time from that 10 minutes, based on the specification of the engine. Further, the predetermined temperature may be 59° C., for example; however, the predetermined temperature may be varied to any temperature from that 59° C., based on the specification of the engine and the position of installation of the cooling water temperature sensor, and the like. In many cases, the relation between the duration of the engine operation and the rough engine temperatures is known. Therefore, the range of the engine temperature can be inferred only with the timer.

In step S3, the control device 90 controls various units so as to cause the heat pump to perform a pump-down operation. Here, the pump-down operation is an operation performed to store the liquid refrigerant in the receiver 117, at a time of stopping the heat pump. In the operation, the third electronic expansion valve 135 and the fourth electronic expansion valve 136 are completely closed. Further, in the cooling operation, the fifth electronic expansion valve 109 is completely closed, and the liquid refrigerant from the first and the second outdoor heat exchangers 123 and 124 is retained in the receiver 117. On the other hand, in the heating operation, the first and the second electronic expansion valves 120 and 121 are completely closed, and the liquid refrigerant from the indoor heat exchanger 108 is retained in the receiver 117. When the pump-down operation ends, the process proceeds to step S4.

In step S4, the control device 90 performs control to stop supplying power to the spark plug 45. Through this, the engine is stopped, and the control ends.

On the other hand, in step S2, in cases where the operating time after the starting of the engine is determined as to be the first predetermined time or shorter, the process proceeds to step S5. In step S5, a self-sustained operation using the bypass channel 157 is performed. To be more specific, in step S5, the control device 90 maintains the operation status of the engine by continuing power supply to the spark plug 45 and the like. Further, the control device 90 adjusts the opening of the sixth electronic expansion valve 162 (see FIG. 2) to a suitable degree of opening, to perform operation of returning gas refrigerant ejected from the compressors 101 and 102 to the compressors 101 and 102, through the oil separator 103, the bypass channel 157 (see FIG. 1), and the accumulator 126, until a condition of the step S6 is met.

In step S6, the control device 90 determines whether the engine cooling water temperature is a predetermined temperature or higher, and whether the degree of superheat of the refrigerant is a predetermined temperature or higher, based on signals from the cooling water temperature sensor 81, the pressure sensor 140, and the temperature sensor 141. Then, in a case where the control device 90 determines that the engine cooling water temperature is the predetermined temperature or higher and the degree of superheat of the refrigerant continues to be the predetermined temperature or higher for a second predetermined time or longer, the process proceeds to step S3 to perform the pump-down operation. In cases where the other statuses are determined by the control device 90, on the other hand, the process proceeds to step S5 to continue the self-sustained operation. It should be noted that the predetermined temperature of the engine cooling water may be 59° C., for example; however, the predetermined temperature may be varied to any temperature from that 59° C., based on the specification of the engine (engine main body is indicated by 4) and the position of installing the cooling water temperature sensor, and the like. Further, the degree of superheat of refrigerant may be 3° C., for example; however, the degree of superheat of refrigerant may be varied to any temperature from that 3° C. based on the specifications of the compressors 101 and 102. Further, the second predetermined time is measured by the timer 88, and is 1 minute for example; however, it may be set to any time other than that 1 minute.

In this embodiment, the timer 88 and the cooling water temperature sensor 81 structures the engine temperature specifying unit. Further, while step S3 and step S4 constitutes a stop control which executes stopping of engine by the control device 90, step S1, step S2, step S5, and step S6 are included in an operation control which executes operation of the engine by the control device 90.

With the above embodiment, operation of the engine is continued, in a case where the control device 90 receives a stop signal instructing stopping of the engine and the control device 90 determines the engine temperature is less than a predetermined temperature. In other words, when the control device 90 receives the stop signal instructing stopping of the engine, the operation control is maintained until the engine temperature is determined as to be the predetermined temperature or higher. Therefore, when the control device 90 receives the stop signal instructing stopping of the engine, the heat from the engine can prevent a drop in the temperature of the blowby gas, and liquefaction of the vapor in the blowby gas can be restrained. Therefore, with the embodiment, when warming up of the engine is not sufficient, the engine can be restrained from repetitively being started and stopped at short intervals, and generation of blowby condensate water can be restrained.

Further, with the above embodiment, the cooling water pump 80 can be driven always while the engine is operated. Therefore, a local hot spot due to stopping of the cooling water pump 80 does not occur in the engine.

Further, with the above described embodiment, the engine temperature can be easily and accurately detected, because the engine temperature specifying unit includes the cooling water temperature sensor 81 configured to detect the engine cooling water temperature.

It should be noted that in the above embodiment, the criterion in step S6 included the degree of superheat of refrigerant; however, in step S6, the criterion may only include the cooling water temperature, instead of including the degree of superheat of refrigerant in the criterion.

Further, in the above embodiment, the engine temperature specifying unit is structured by the timer 88 and the cooling water temperature sensor 81. However, the engine temperature specifying unit may be structured only by the timer. In this case, the operation time of the engine from the start of the engine may be determined with the timer, and when the operation time of the engine is a predetermined time or longer, the stop control which executes stopping of the engine may be performed, and on the other hand, when the operation time of the engine is shorter than the predetermined time, the operation control which executes operation of the engine may be continued.

Further, the engine temperature specifying unit may be structured only by the cooling water temperature sensor 81. Then, temperature of the cooling water may be detected by the cooling water temperature sensor 81, and when the temperature of the cooling water is a predetermined temperature or higher, the stop control which executes stopping of the engine may be performed, and on the other hand, when the temperature of the cooling water is lower than the predetermined temperature, the operation control which executes operation of the engine may be continued.

Further, the engine temperature specifying unit may be structured by the exhaust gas temperature sensor 76. Then, temperature of the exhaust gas may be detected by the exhaust gas temperature sensor 76, and when the temperature of the exhaust gas is a predetermined temperature or higher, the stop control which executes stopping of the engine may be performed, and on the other hand, when the temperature of the exhaust gas is lower than the predetermined temperature, the operation control which executes operation of the engine may be continued.

The engine temperature specifying unit may be structured by any one or more units that can specify whether the warming up of the engine is a predetermined level or higher or less.

Further, in the above embodiment, the stop signal indicative of stopping of the engine is the thermo signal; however, the stop signal indicative of stopping of the engine may be a signal input (sent) by a user through an operation unit, which instructs the stopping of the engine.

It should be noted that, in the above embodiment, the engine is a gas engine; however, the engine may be an engine other than a gas engine, and may be for example, a gasoline engine, a diesel engine, and the like. The engine may be any engine provided that blowby gas is generated.

Further, in the above embodiment, the engine is an engine that drives a heat pump; however, the engine does not have to be an engine for driving a heat pump, and may be an engine that drives a vehicle or ship.

It goes without saying that two or more structures out of the entire structure described in the above embodiments and modification may be combined to construct a new embodiment.

Preferred embodiments of the present invention are thus sufficiently described with reference to attached drawings; however, it is obvious for a person with ordinary skill in the art to which the present invention pertains that various modification and changes are possible. Such a modification and changes, unless they depart from the scope of the present invention as set forth in claims attached hereto, shall be understood as to be encompassed by the present invention.

The entire disclosure of the specification, drawings, and claims of Japanese patent application No. 2015-53180 filed on Mar. 17, 2015 is incorporated in this specification by reference.

REFERENCE SIGNS LIST

81 cooling water temperature sensor
88 timer
90 control device

The invention claimed is:

1. An engine comprising:

an engine temperature specifying unit including a timer configured to measure duration of an operation of the engine, the engine temperature specifying unit configured to specify an engine temperature according to the duration measured by the timer; and a control device configured to control the engine based on the engine temperature specified by the engine temperature specifying unit, wherein, to control the engine, the control device is configured to:

during the operation of the engine, receive a stop signal indicative of an instruction to stop the engine; and in response to the stop signal, continue the operation of the engine based on a determination, by the control device, that the engine temperature is less than a predetermined temperature, and based on a determination, by the control device, that a degree of superheat of a refrigerant is less than a predetermined amount.

2. The engine according to claim 1, wherein the engine temperature specifying unit includes a cooling water temperature sensor configured to detect an engine cooling water temperature.

3. The engine according to claim 1, wherein the degree of the refrigerant is associated with a refrigerant line coupled to a compressor and to an accumulator.

4. The engine according to claim 1, wherein the control device is further configured to, in response to the stop signal, determine whether the engine temperature is greater than or equal to the predetermined temperature.

5. The engine according to claim 1, wherein the control device is further configured to, in response to the stop signal, determine whether the degree of superheat of the refrigerant is greater than or equal to the predetermined amount.

6. The engine according to claim 1, wherein the control device is further configured to, after the stop signal is received by the control device, stop the operation of the engine based on a determination that the degree of superheat of the refrigerant is greater than or equal to the predetermined amount.

7. The engine according to claim 1, wherein the control device is further configured to, after the stop signal is received by the control device, stop the operation of the engine based on a determination that the engine temperature is greater than or equal to the predetermined amount.

8. The engine according to claim 7, wherein the control device is further configured to stop the operation of the engine after a pup down operation of a heat pump is performed.

9. The engine according to claim 1, further comprising a heat pump.

10. The engine according to claim 9, wherein the heat pump includes a pressure sensor configured to detect a pressure of a refrigerant line and to output, to the control device, a first output signal associated with the pressure.

11. The engine according to claim 10, wherein the heat pump includes a temperature sensor configured to detect a line temperature associated with the refrigerant line and to output, to the control device, a second output signal associated with the line temperature.

12. The engine according to claim 11, wherein the control device is further configured to:

determine a saturated steam temperature of the refrigerant line based on the first output signal; and determine the degree of superheat of the refrigerant based on the saturated steam temperature and based on the second output signal.

13. The engine according to claim 1, wherein the stop signal comprises a thermo signal that indicates that a room temperature has reached a set temperature.

14. The engine according to claim 1, further comprising:

an accumulator configured to separate gas refrigerant and mist refrigerant; and a compressor configured to receive gas refrigerant from the accumulator via a refrigerant line.

* * * * *